United States Patent [19]

Svyatsky et al.

[11] Patent Number: 4,974,826

[45] Date of Patent: Dec. 4, 1990

[54] DOCUMENT STACKING APPARATUS

[75] Inventors: Edward M. Svyatsky, Chicago; K. George Rabindran, Morton Grove, both of Ill.; Kevin Beers, Sacramento, Calif.

[73] Assignee: Bell & Howell Company, Chicago, Ill.

[21] Appl. No.: 313,986

[22] Filed: Feb. 22, 1989

Related U.S. Application Data

[63] Continuation-in-part of Ser. No. 109,058, Oct. 15, 1987, abandoned.

[51] Int. Cl.[5] ..... B65H 29/42

[52] U.S. Cl. ..... 271/179; 271/2; 271/181; 271/215

[58] Field of Search ..... 271/31.1, 149, 178, 271/179, 180, 181, 184, 213–215, 306, 314, 315, 225, 264, 176, 2

[56] References Cited

U.S. PATENT DOCUMENTS

| | | | |
|---|---|---|---|
| 3,160,293 | 12/1964 | Hennequin | 271/179 |
| 3,682,473 | 8/1972 | Kuyt | 271/179 |
| 3,708,054 | 1/1973 | Gilev et al. | 271/179 |
| 3,712,487 | 1/1973 | Eberle | 271/179 |
| 3,995,851 | 12/1976 | Casper | 271/179 |
| 4,509,739 | 4/1985 | Kurokawa | 271/179 |
| 4,657,241 | 4/1987 | Frank | 271/179 |

*Primary Examiner*—H. Grant Skaggs

*Attorney, Agent, or Firm*—Neuman, Williams, Anderson & Olson

[57] ABSTRACT

Apparatus for stacking a plurality of documents on one edge thereof in vertically disposed position which comprises a movable stacker carriage adapted for movement between a forward and a rear position. An upper stacking screw worm rotatable about a horizontal axis is rigidly attached to the movable stacker carriage and functions to move documents laterally away from the carriage and into stacked relationship. At least one lower stacking screw worm and preferably two lower stacking screw worms rotatable about horizontal axes are rigidly attached to the movable stacker carriage and function to move documents laterally away from the carriage and into stacked relationship. The upper and lower stacking screw worms are rotatable. The stacking apparatus is adapted for use with a device for delivering single documents thereto and the stacking apparatus can be used with a movable transport element such as a conveyor for transporting stacked documents. The stacking apparatus is adapted for movement in response to the pressure of the stacked documents and a sensor can be cooperatively disposed so as to be actuated by movement of the stacking apparatus whereby movement of the moveable transport element carrying stack documents is controlled in response to actuation of the sensor. The sensor such as an electrical contact switch or a photo electric cell can be used to detect movement of the stacking apparatus.

44 Claims, 4 Drawing Sheets

DOCUMENT STACKING APPARATUS

This application is a continuation-in-part of Ser. No. 109,058 filed Oct. 15, 1987, now abandoned.

BACKGROUND

This invention relates to apparatus for handling documents and more particularly to apparatus for receiving documents at a high rate of speed and stacking the documents on one edge thereof in a vertically disposed plane.

The use of various machines for automatically handling documents such as mailing envelopes at high speed finds increasingly widespread use in commercial and governmental institutions. Among such machines are those which are adapted to receive documents which are singly delivered thereto at a high velocity and to stack the documents on one edge thereof so that the documents are neatly arranged in a stack in a vertical plane. Prior art stacking devices are known.

Problems are often encountered in automatically stacking documents at high speeds. For example, if the documents in the stack are pressed together too tightly in forming the stack, damage to the documents can occur. For example, window type mailing envelopes often become torn adjacent the window which not only damages the envelope itself but may cause a jam in the stacking apparatus necessitating shut-down of the device. On the other hand, if the single documents are not held sufficiently tight in the stack, the documents may become skewed and through-put of the machine greatly reduced.

It is a principal object of this invention to provide improved apparatus for automatically stacking documents at high speed.

It is another object of the invention to provide apparatus for automatically stacking documents on one edge thereof in a vertical plane at high speed.

Another object of this invention is to provide document stacking apparatus which is self-adjusting in response to the pressure exerted on a stack of documents.

A further object of this invention is to provide document stacking apparatus which is adjustable to accommodate documents of varying size.

SUMMARY OF THE INVENTION

The stacking apparatus of this invention is adapted for receiving at high speeds single documents which are fed thereto in free flight manner and forming a stack of the documents disposed in vertical plane. The stack can be formed at a desired location and the stacker of this invention can be used to form a document stack in a stationary bin or on a stationary platform or more usually on a transport raceway, such as a conveyor, whereby the stacks as formed can be transported away from the stacking operation for further handling as required. The stacker of the invention is admirably suited for use with high speed feeding devices which feed single documents in free flight at high speeds, such as mail sorting and inserter machines.

The present invention provides apparatus for stacking a plurality of documents on one edge thereof in vertically disposed position. The apparatus comprises a moveable stacker carriage for receiving documents and which is adapted for movement between a forward and rear position. Means are provided on the carriage for laterally moving documents away from said carriage and into stacked relationship. Means for biasing said carriage toward the forward position and means for moving said stacker carriage away from said forward position in response to the pressure of stacked documents are also provided.

One preferred embodiment of this apparatus comprises a slidable stacker carriage adapted for longitudinal horizontal movement between a front and rear position. An upper stacking screw worm rotatable about a horizontal axis is rigidly attached to said slidable stacker carriage and functions to move documents laterally away from said carriage and into stacked relationship. At least one lower stacking screw worm and preferably two lower stacking screw worms rotatable about horizontal axes are rigidly attached to the slidable stacker carriage and function to move documents laterally away from said carriage and into stacked relationship. The apparatus is provided with means for rotating the upper and lower stacking screw worms. The stacking apparatus is adapted for movement in a horizontal direction in response to the pressure of the stacked documents and sensing means can be cooperatively disposed so as to be actuated by horizontal movement of the stacking apparatus whereby movement of moveable transport means carrying stacked documents is controlled in response to actuation of the sensing means. Sensing means such as an electrical contact switch or a photoelectric cell can be used to detect horizontal movement of the stacking apparatus.

DESCRIPTION OF THE DRAWINGS

The above and other objects and advantages of the invention will be apparent from the following description taken in conjunction with the accompanying drawings wherein.

DISCUSSION OF PRIOR ART

Figure 1:
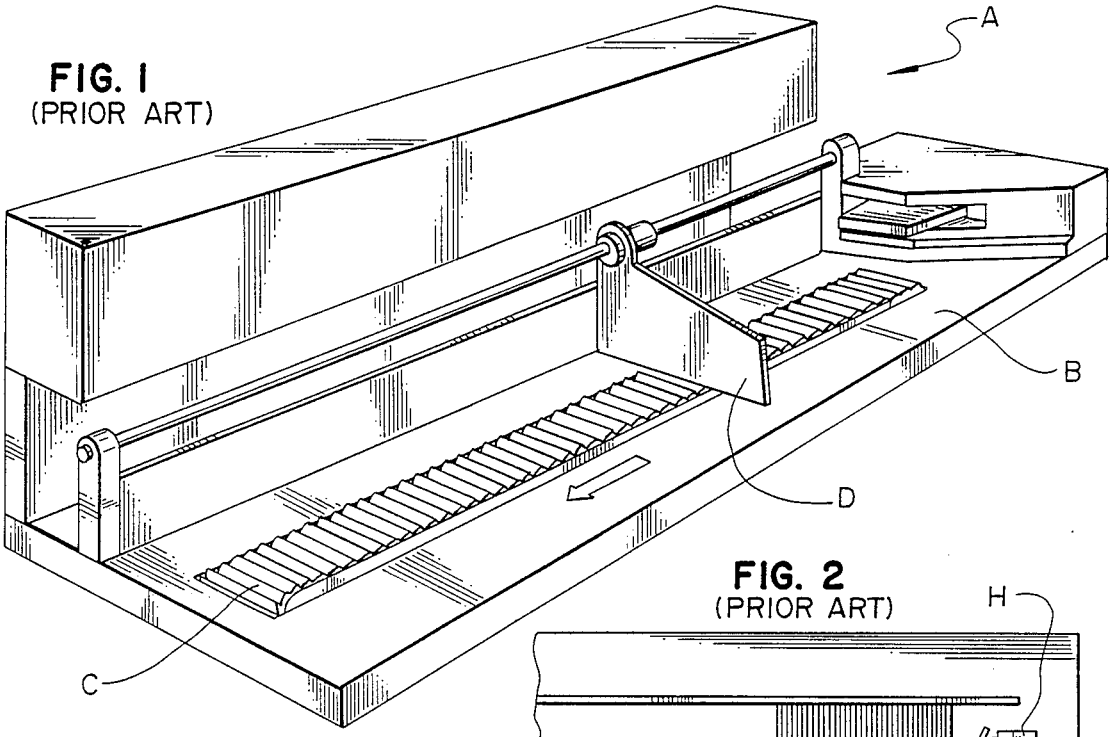
FIG. 1 (PRIOR ART)
FIG. 1 is a perspective view of a document stacking station including prior art document stacking means.
Figure 2:
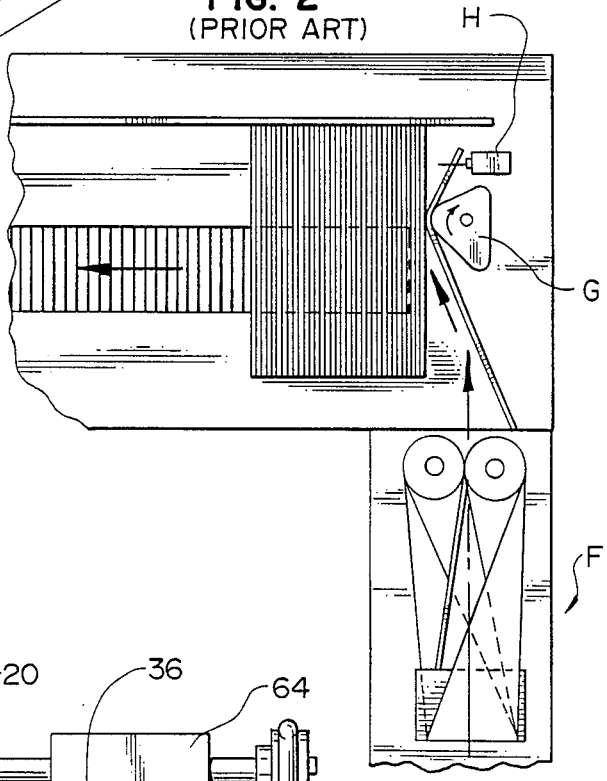
FIG. 2 (PRIOR ART)
FIG. 2 is a partial diagrammatical plan view of the stacking station of FIG. 1 and prior art document stacking means as well as document feeding means.

FIG. 1 shows in perspective a document stacking station designated generally by the letter A comprising a longitudinally extending raceway B in which conveyor C moves in the direction of the arrow. A document back-up plate D is slidably attached to rail E. As shown in FIG. 2, a document feeding machine F feeds, as shown by the arrows, single documents disposed in a substantially vertical plane. The operative stacking mechanism G comprises a beater wheel which rotates so as to direct the incoming documents into stacking alignment. Sensing means H can be employed to actuate movement of the conveyor C when the stacked documents come into contact therewith. The operative beater wheel G is stationary and does not move in response to the stack pressure. Quite often, particularly when operating at high speeds, the incoming documents become jammed at the point at which they contact the beater wheel. When a jam occurs at this point, the stacking operation must be stopped and the jam manually cleared. The sensing means H does not operate to clear the jam because the jam itself prevents build-up of the stack so as to cause the sensing means to actuate movement of the conveyor.

DETAILED DESCRIPTION OF THE INVENTION

The stacking apparatus of the invention will be described as used in association with a transport raceway on which the document stack is formed.

Referring to the drawings, numeral 10 designates a conveyor (partially shown) on which a stack 12 of individual documents 13, such as mailing envelopes, are deposited for transport along a raceway stacked on an edge in a vertical plane. The documents 13 are fed singly from suitable feeding apparatus 15 of known type so as to be guided by the vertically extending angled guide plate 16. The documents in free flight first contact the portion 17 which is disposed at an acute angle to the plane of flight of the documents and are guided thereby by their own momentum into stacking alignment parallel to the portion 19 of guide plate 16. A flat spring 20 attached to the upper portion of guide plate 16 and biased outwardly therefrom serves to maintain the individual document in a substantially vertical position and spaced from the face of guide plate 16.

Figure 3:
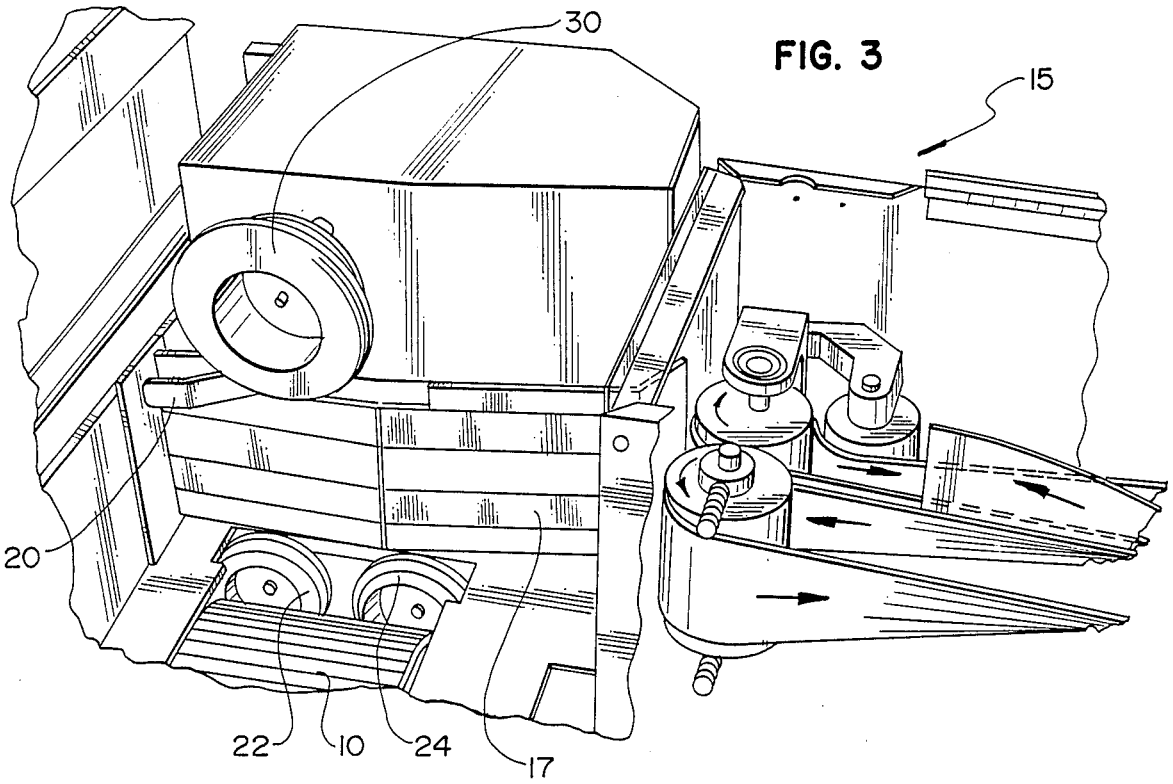
FIG. 3 is a perspective view of one preferred document stacking apparatus in accordance with this invention in association with a document feeding device.
Figure 4:
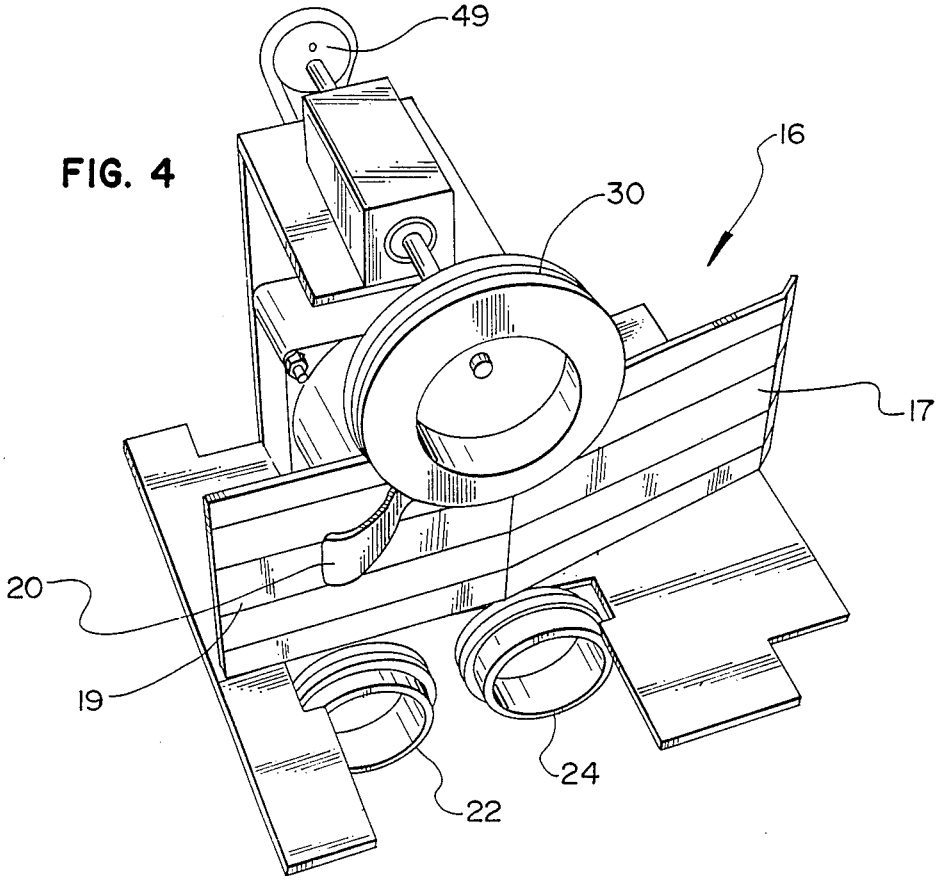
FIG. 4 is a frontal perspective view showing the preferred embodiment of the stacking apparatus according to this invention.
Figure 5:
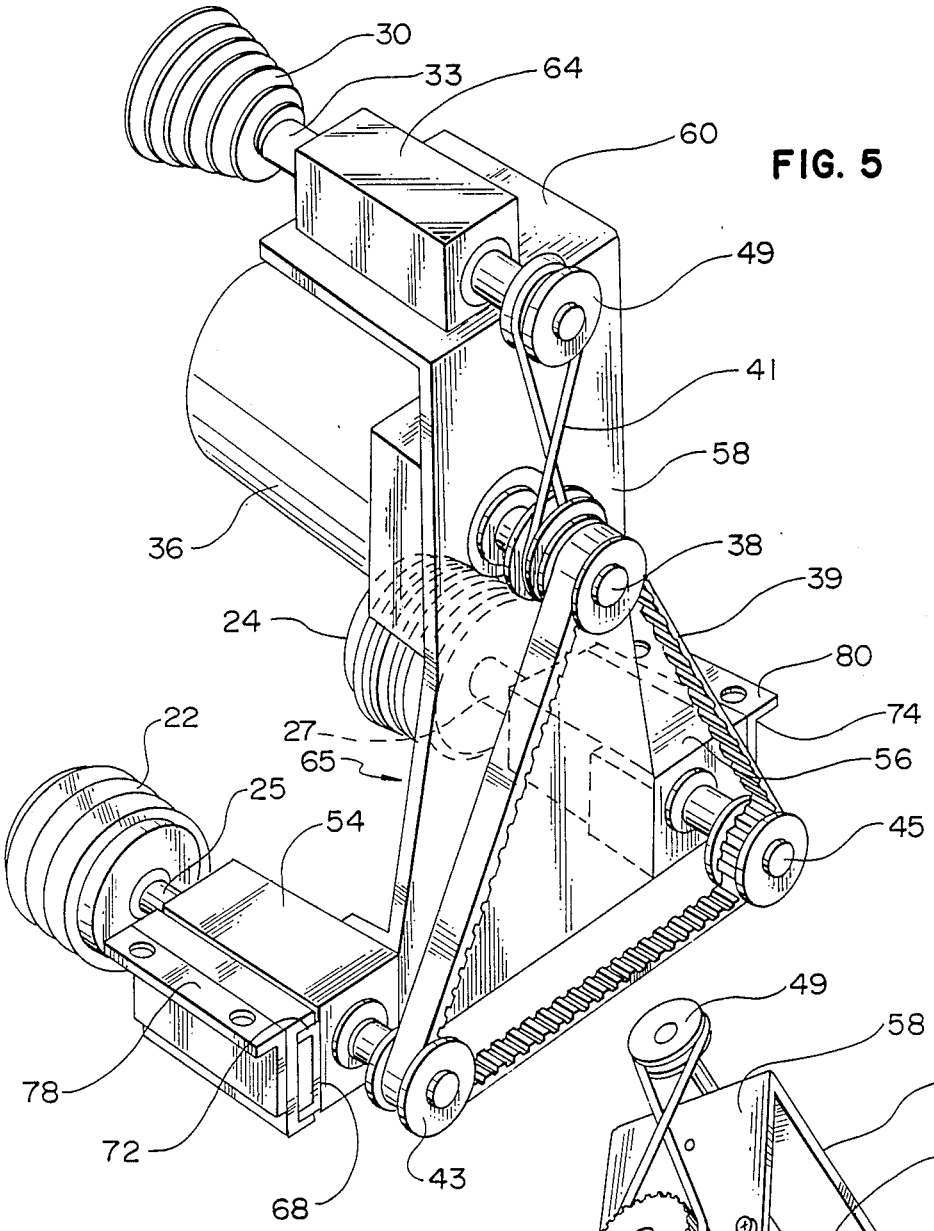
FIG. 5 is a rear perspective view showing the principal components of the preferred stacking apparatus of the invention.
Figure 6:
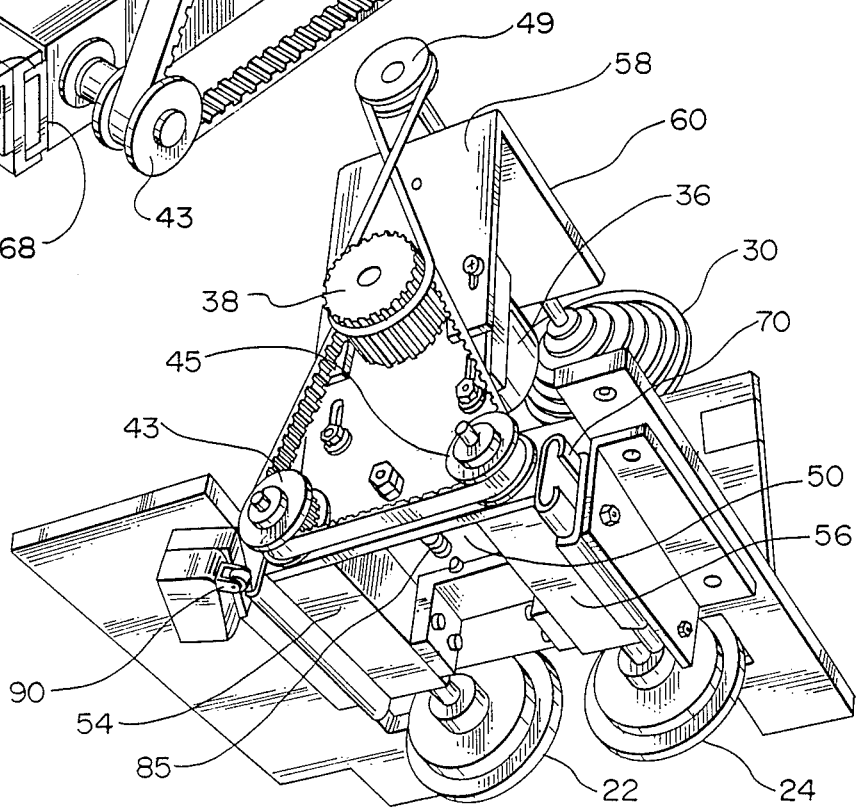
FIG. 6 is a bottom perspective view showing the principal components of the preferred stacking apparatus of the invention.

The principal components of the novel stacker of this invention are shown in greater detail in FIGS. 3, 4 and 5. The preferred stacking apparatus includes two bottom worm screws or augers 22 and 24. These augers are conical in shape and are adapted for rotation about axes which are transverse to the direction of travel of documents entering the stacker. Auger 22 has a left-hand thread and is adapted for clockwise rotation about shaft 25 while auger 24 has a left-hand thread and is adapted for clockwise rotation about shaft 27 (as viewed in FIG. 5). A top auger 30 has a right-hand thread and a conical shape with its apex projecting inwardly into the area in which the documents are initially received. This conical shape of top auger 30 is important since it affords ready reception of incoming documents. Top auger 30 is adapted for counterclockwise rotation about shaft 33 (as viewed in FIG. 5). The augers 22, 24 and 30 function to remove the documents laterally away from guide plates 16 toward the back-up plate 34.

Rotation of the augers 22, 24 and 30 is accomplished by means of electric motor 36 acting through shaft 38, cooperating drive belts 39 and 41 and drive pulleys 43, 45, 47 and 49. The motor, as well as the drive belt and pulley arrangement, can be various known types and are selected so as to effect rotation of the stacking augers 22, 24 and 30 at a desired speed which depends to large extent upon the rate at which documents are fed to the stacker. Thus, for example, when documents are fed singly to the stacking apparatus at a rate of 6000 per hour, the stacking augers are rotated at approximately 200 revolutions per minute, depending on auger size, pitch, angle and shape of threads.

The unitary support structure for the automatic stacker includes a base plate 50 to which are rigidly attached bearing blocks 54 and 56, a vertically upstanding frame 58 and a flat top plate 60 to which is rigidly attached bearing block 64. This supporting structure, including base plate 50, vertical frame 58 and top plate 60, together with the attached bearing blocks 54, 56 and 64, constitute a unitary structure or carriage designated generally by the numeral 65 for the stacking augers 22, 24 and 30. The augers 22, 24 and 30 are adapted for rotation within the respective bearing blocks 54, 56 and 64 without any longitudinal movement therein. However, a unique and novel feature of the invention is the provision of means for slidable movement of the stacking augers in response to pressure exerted by the stacked documents. To this end, each of bearing blocks 54 and 56 are provided on the exterior sides thereof with longitudinally extending slide rails 68 and 70. The slide rails 68 and 70 are slidably received within a generally U-shaped track members 72 and 74 which are carried respectively by brackets 78 and 80 by which the stacking mechanism is attached to the table of the document handling system. By virtue of this arrangement the slidable carriage 65 is permitted to move longitudinally in response to pressure exerted by build-up of a document stack. The slidable carriage 65 is normally biased to a forward position by coil spring 85.

The longitudinal movement rearwardly of the slidable carriage 65 is limited by a fixed stop.

Figure 7:
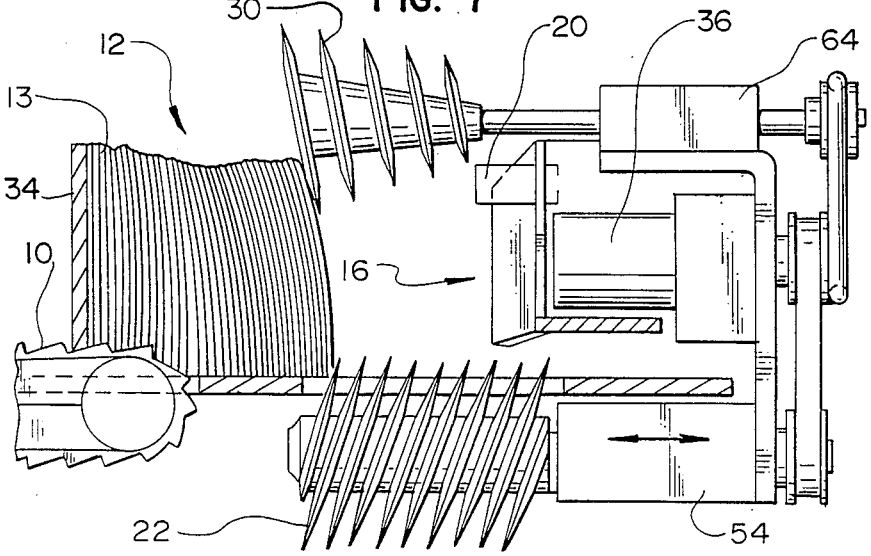
FIG. 7 is a side elevational view showing the principal components of the preferred stacking apparatus of the invention and also showing a portion of a transport means for transporting stacked documents.

In operation, documents which include sheets, envelopes and the like are fed singly from a high speed feeding device 15. The documents in free flight can be fed at various speeds as is known in the art. The documents are guided by the angled portion 17 to the straight portion 19 of guide plate 16. Leaf spring 20 serves to maintain the documents in generally upright, vertical position on an edge thereof and prevents the documents from lying flat against the guide plate. The rotating augers 22, 24 and 30 grasp the documents in the spiral grooves and carry the documents laterally away from the entrance point and stack the documents against back-up plate 34. As the document stack builds up in size, it exerts pressure against the top auger 30 (FIG. 7). In response to the pressure the slidable carriage 65 is forced to move rearwardly which prevents stacking of the documents too tightly which can cause damage thereto.

If desired, suitable sensing means, such as an electrical contact switch, can be disposed in position such that the slidable carriage contacts and actuates it when moved rearwardly. The contact switch 90 can be part of an electrical circuit which operates the transport or conveyor 10. Thus, when the sensing means is contacted by the slidable carriage of the stacker an electrical circuit can be closed so as to actuate the conveyor and move stacked documents thereon away from the stacking apparatus. Sensing means 90 other than an electrical contact switch, such as photoelectric cells, magnetic sensors and the like can be used.

According to another preferred embodiment of the invention, the stacking apparatus of the invention is adjustably adapted to accommodate documents of different sizes.

Documents which are to be stacked at high speeds come in different sizes and in many use applications documents such as envelopes of one size are stacked for a period and then envelopes of a different size are fed to the stacking operation. The embodiments of the invention as illustrated in FIGS. 8 through 10 involve document stacking apparatus having a moveable stacking carriage for receiving documents and which is adapted for movement between a forward and rear position and which is also adapted for vertical adjustment to accommodate documents of different sizes.

Figure 8:
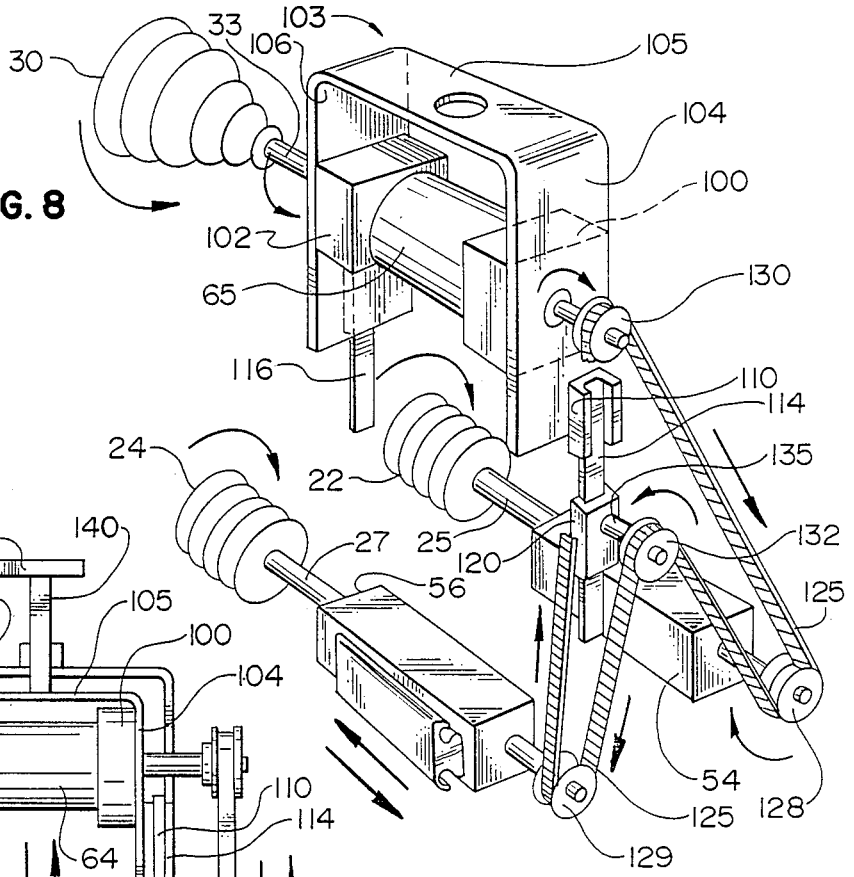
FIG. 8 is a partial diagrammatical perspective view of another preferred embodiment of stacking apparatus in accordance with the invention which is adapted for adjustment to accommodate documents of various sizes.
Figure 9:
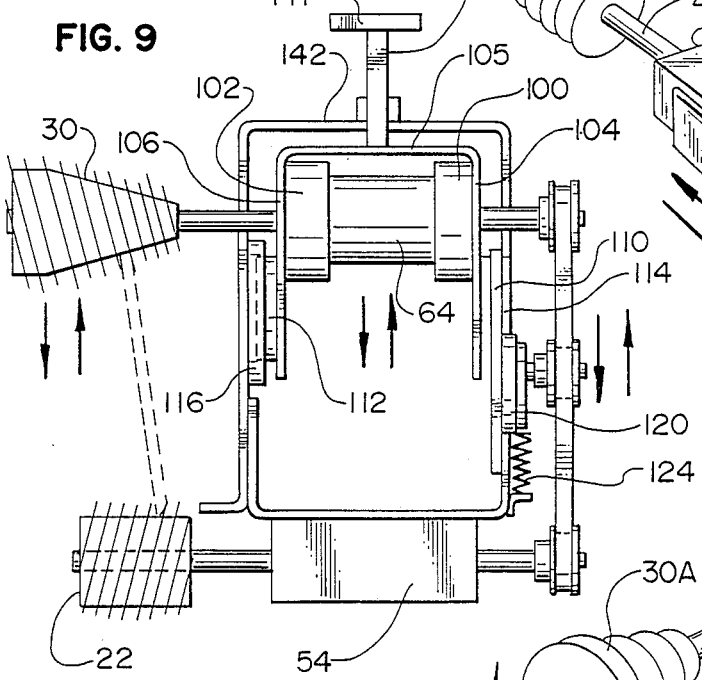
FIG. 9 is a diagrammatical side elevational view of the stacking apparatus of FIG. 8.
Figure 10:
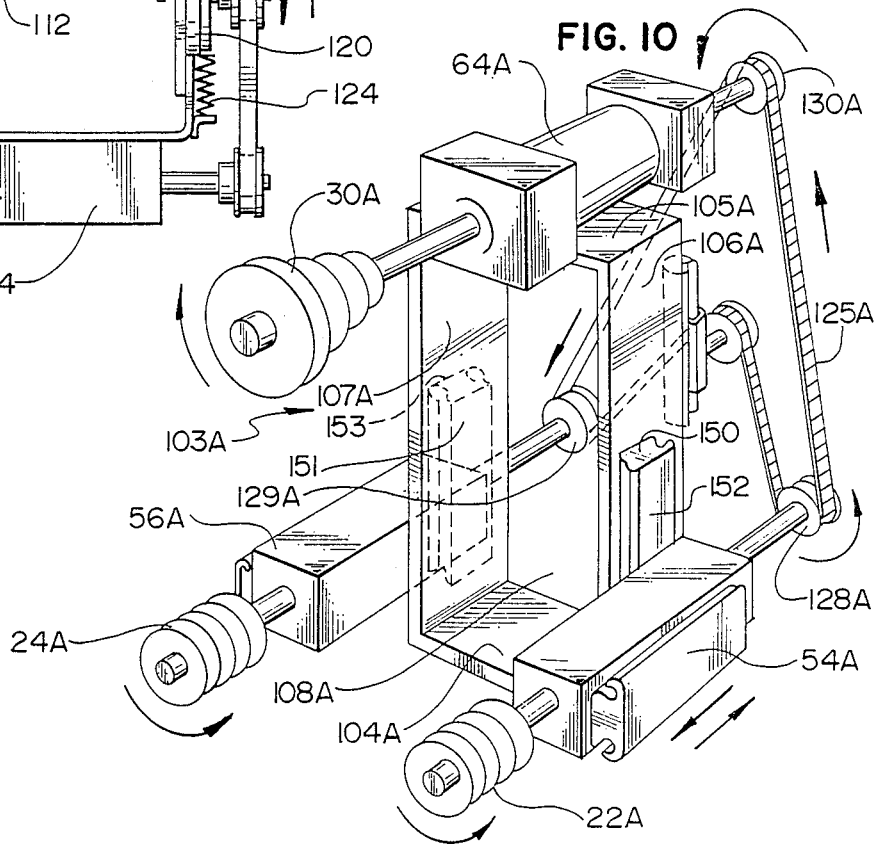
FIG. 10 is a partial diagrammatical perspective view of another embodiment of stacking apparatus in accordance with the invention which is adapted for adjustment to accommodate documents of various sizes.

With specific reference to FIGS. 8 and 9, the top auger 30 is adapted for up and down vertical movement. Thus, top auger 30 rotates about shaft 33 which is journaled through gear box 102, motor 65 and a second gear box 100 in a manner which permits the shaft to rotate therein without any longitudinal movement. The drive system gear boxes 102 amd 100 and motor 65 in turn are rigidly secured to the carrier hood. This embodiment of the invention is comprised of a carrier hood 103 having a back plate 104, a top plate 105 and front plate 106. Secured to the exterior faces of back member 104 and front plate 106 of the housing are brackets 110 and 112 in which slide rails 114 and 116 are slidable. The lower end of rear slide rail 114 is slidably engaged within bracket 120. Spring 124 attached to the lower end of slide rail 114 and the stacker frame exerts an upward biasing action on the slide rail 114. The augers 22, 24 and 30 are caused to rotate on respective shafts 25, 27 and 33 by the drive belt 125 and cooperating drive pulleys 128, 129 and 130. The shaft members 25, 27 and 33 are held within drive pulleys 128, 129 and 130 so as to rotate with the pulley members. The drive belt 125 traverses tension pulley 132 which rotates about shaft 135 which is secured to the spring-loaded bracket 120 and exerts sufficient tension on drive belt 125 so as to effect rotation of the drive pulleys 128, 129 and 130 and the stacking augers 22, 24 and 30. Means such as an electric motor 64 shown in FIG. 8 is used to actuate drive belt 125 and to rotate augers 22, 24 and 30 at a desired speed. An adjusting screw 140 protrudes within the housing 142 to position the carrier hood 103 at a desired height depending on the size of the documents being fed to the stacking apparatus.

The stacking apparatus illustrated in FIG. 8 and 9 operates as previously described so that as the document stack builds up in size it exerts pressure against the auger system 22, 24 and 30 (FIG. 7). In response to the pressure, the slidable carriage is forced to move rearwardly to prevent stacking the documents too tightly.

When there is a change in the size of the documents to be stacked, the top auger 30 can be adjusted vertically up or down depending upon the size of the documents. Vertical adjustment of the top auger 30 is accomplished by turning set screw 140 by means of handle 141 so as to raise or lower carrier hood 103. Clockwise rotation of set screw 140 causes the carrier hood 103 to move downwardly thus decreasing the distance between top auger 30 and the bottom augers 22 and 24 so as to accommodate documents of smaller size. Counterclockwise rotation of set screw 140 increases the distance between the stacking augers to accommodate larger documents. Carrier hood 103 is held in desired vertical position by the positioning of set screw 140. In this embodiment of the invention, pressure of the document stack against the auger system causes bearing blocks 54 and 56 to move rearwardly and this rearward movement is transmitted through the housing 142 so as to cause the bearing blocks 54 and 56 along with the lower stacking augers 22 and 24 to simultaneously move rearwardly. Thus, in this embodiment of the invention the unitary slidable carriage which is adapted for horizontal movement in response to the pressure of stacked documents comprises all of the members shown in FIG. 9.

FIG. 10 illustrates another embodiment of the stacking apparatus of the invention which is adapted for vertical adjustment to accommodate documents of varying sizes. In this embodiment of the invention a unitary carrier hood 103A has a top 105A, a bottom 104A, two sides 106A and 107A and a back 108A. The opposed side members 106A and 107A have secured on the exterior surfaces thereof slide brackets 150 and 151 in which are slidably engaged slide tracks 152 and 153 which are secured to bearing blocks 54A and 56A, respectively. Thus, the top auger 30A can be raised or lowered with respect to the bottom augers 22A and 24A as desired to accommodate documents of varying size. In the embodiment of the invention illustrated in FIG. 10, the unitary slidable carriage which is adapted for horizontal movement in response to the pressure of stacked documents comprises all of the members shown in FIG. 10.

Those modifications and equivalents which fall within the spirit of the invention are to be considered a part thereof.

What is claimed is:

1. Apparatus for stacking a plurality of documents on one edge thereof in vertically disposed position comprising:

a movable stacker carriage having an open unrestricted area wherein documents at the rate documents are fed thereto from a high speed feeding device, are received in stacking alignment and spaced from the stack of documents to which they are to be added, said stacker carriage being adapted for movement between a forward and rearward position, means associated with said stacker for laterally moving the received and aligned documents into stacked relationship, means for biasing said carriage toward the forward position, and said stacker carriage being adapted for movement away from said forward position in response to the pressure or position of stacked documents.

2. In combination, means for delivering single documents in a vertically disposed plane to a stacking apparatus as defined in claim 1, and means for transporting a stack of documents away from said stacking apparatus.

3. The combination of claim 2 which includes means for activating the transporting means when said movable carriage is not biased to said forward position.

4. Apparatus in accordance with claim 1 having means for guiding the incoming documents into stacking alignment.

5. Apparatus for stacking a plurality of documents on one edge thereof in vertically disposed position comprising:

a movable stacker carriage having an open unrestricted area wherein documents at the rate documents are fed thereto from a high speed feeding device, are received in stacking alignment and spaced from the stack of documents to which they are to be added, said stacker carriage being adapted for movement between a forward and rearward position, an upper stacking screw worm rotatable about a horizontal axis rigidly attached to said movable stacker carriage which functions to move documents laterally away from said carriage and into stacked relationship, at least one lower stacking screw worm rotatable about a horizontal axis rigidly attached to said movable stacker carriage which functions to move documents laterally away from said carriage and into stacked relationship, and means for rotating the upper and lower stacking screw worms.

6. Apparatus in accordance with claim 5 having two lower screw worms rigidly attached to said movable stacker carriage, both of said lower screw worms being adapted for clockwise rotation whereby said screw worms function to move documents laterally away from said carriage and into stacked relationship.

7. Apparatus in accordance with claim 5 wherein the upper screw worm is adapted for counterclockwise rotation.

8. Apparatus in accordance with claim 5 wherein said upper screw worm is conical in shape with the apex of the cone projecting inwardly toward said stacker carriage.

9. Apparatus in accordance with claim 5 having an angled guide plate member attached to the front of said carriage for directing and maintaining incoming documents in a vertical position for engagement with said stacking screw worms.

10. Apparatus in accordance with claim 9 having a leaf spring on the forward exterior face of said guide plate member which urges the upper free end of each document away from said guide plate member.

11. Apparatus in accordance with claim 5 wherein the means for rotating the stacking screw worm comprises a motor and a belt and pulley drive connection.

12. Apparatus in accordance with claim 11 wherein the motor is an electric motor.

13. Apparatus in accordance with claim 5 having spring means to normally bias the stacker carriage in forward position.

14. In combination, means for delivering single documents in a vertically disposed plane to a stacking apparatus as defined in claim 5, and means for transporting a stack of documents away from said stacking apparatus.

15. The combination of claim 14 wherein the means for transporting a stack of documents away from said stacking apparatus includes conveyor means.

16. In combination, means for delivering single documents at high speed and in a vertically disposed plane to a stacking apparatus as defined in claim 5, means for transporting a stack of documents away from said stacking apparatus, and means for effecting transport of a stack of documents away from said stacking apparatus in response to movement of the slidable stacker carriage.

17. The combination of claim 16 wherein the means for transporting a stack of documents away from said stacking apparatus includes conveyor means.

18. Apparatus for stacking a plurality of documents on one edge thereof in vertically disposed position comprising:

a unitary slidable stacker carriage adapted for longitudinal horizontal movement between a forward and rear position having a base plate, a vertically extending back member and a top plate, a bearing block rigidly secured to said top plate, at least one bearing block rigidly secured to said base plate, rotatable shaft members journaled within each of said bearing blocks, worm screws operatively connected to all of said rotatable shaft members at the forward ends thereof which function to move documents laterally away from said carriage and into stacked relationship, and means for effecting rotation of said rotatable shafts and said worm screws.

19. Apparatus in accordance with claim 18 having two bearing blocks rigidly secured to said base plate.

20. Apparatus in accordance with claim 18 wherein the rotatable shaft member journaled within the bearing block rigidly secured to said base plate rotate clockwise and the rotatable shaft journaled within the bearing block secured to said top plate rotates counterclockwise.

21. Apparatus in accordance with claim 18 wherein said upper screw worm is conical in shape with the apex of the cone projecting inwardly toward said stacker carriage.

22. Apparatus in accordance with claim 18 having spring means to normally bias the stacker carriage in forward position.

23. Apparatus in accordance with claim 18 wherein the means for rotating the stacking screw worm comprises a motor and a belt and pulley drive connection.

24. Apparatus in accordance with claim 23 wherein the motor is an electric motor.

25. Apparatus in accordance with claim 18 wherein the vertical distance between the upper stacking screw worm and the lower stacking screw worm is adjustable.

26. In combination, means for delivering single documents at high speed and in a vertically disposed plane to a stacking apparatus as defined in claim 18, and means for transporting a stack of documents away from said stacking apparatus.

27. The combination of claim 26 wherein the means for transporting a stack of documents away from said stacking apparatus includes conveyor means.

28. In combination, means for delivering single documents at high speed and in a vertically disposed plane to a stacking apparatus as defined in claim 18, means for transporting a stack of documents away from said stacking apparatus, and means for effecting transport of a stack of documents away from said stacking apparatus in response to movement of the slidable stacker carriage.

29. The combination of claim 28 wherein the means for transporting a stack of documents away from said stacking apparatus includes conveyor means.

30. Apparatus for stacking a plurality of documents on one edge thereof in vertically disposed position comprising:

a unitary slidable stacker carriage adapted for longitudinal horizontal movement between a forward and rear position having a base plate, a vertically extending back member and a top plate, a bearing block rigidly secured to said top plate, at least one bearing block rigidly secured to said base plate, rotatable shaft members journaled within each of said bearing blocks, worm screws operatively connected to all of said rotatable shaft members at the forward ends thereof which function to move documents laterally away from said carriage and into stacked relationship, means for effecting rotation of said rotatable shafts and said worm screws, and sliding means associated with said carriage whereby the carriage is slidable between the forward and rear position.

31. Apparatus for stacking a plurality of documents on one edge thereof in vertically disposed position comprising:

a unitary slidable stacker carriage adapted for longitudinal horizontal movement between a forward and rear position having a base plate, a vertically extending back member and a top plate, a bearing block rigidly secured to said top plate, two bearing blocks rigidly secured to said base plate, rotatable shaft members journaled within each of said bearing blocks, worm screws operatively connected to all of said rotatable shaft members at the forward ends thereof which function to move documents laterally away from said carriage and into stacked relationship, means for effecting rotation of said rotatable shafts and said worm screws, and sliding means associated with said carriage whereby the carriage is slidable between the forward and rear position.

32. Apparatus in accordance with claim 31 wherein the rotatable shaft members journaled within the lower bearing blocks rotate clockwise and the rotatable shaft journaled within the bearing block attached to said top plate rotates counterclockwise.

33. Apparatus in accordance with claim 31 wherein said upper screw worm is conical in shape with the apex of the cone projecting inwardly toward said stacker carriage.

34. Apparatus in accordance with claim 31 having an angled guide plate member attached to the front of said carriage for directing and maintaining incoming documents in a vertical position for engagement with said stacking screw worms.

35. Apparatus in accordance with claim 34 having a leaf spring on the forward exterior face of said guide plate member which urges the upper free end of each document away from said guide plate member.

36. Apparatus in accordance with claim 31 wherein the means for rotating the stacking screw worm comprises a motor and a belt and pulley drive connection.

37. Apparatus in accordance with claim 36 wherein the motor is an electric motor.

38. Apparatus in accordance with claim 31 having spring means to normally bias the stacker carriage in forward position.

39. In combination, means for delivering single documents at high speed and in a vertically disposed plane to a stacking apparatus as defined in claim 32, and means for transporting a stack of documents away from said stacking apparatus.

40. The combination of claim 39 wherein the means for transporting a stack of documents away from said stacking apparatus includes conveyor means.

41. In combination, means for delivering single documents at high speed and in a vertically disposed plane to a stacking apparatus as defined in claim 31, means for transporting a stack of documents away from said stacking apparatus, and means for effecting transport of a stack of documents away from said stacking apparatus in response to movement of the slidable stacker carriage.

42. The combination of claim 41 wherein the means for transporting a stack of documents away from said stacking apparatus includes conveyor means.

43. Apparatus in accordance with claim 41 wherein the vertical distance between the upper stacking screw worm and the lower stacking screw worm is adjustable.

44. Apparatus for stacking a plurality of documents on one edge thereof in vertically disposed position comprising:

a movable stacker carriage having an open unrestricted area for receiving and aligning documents at the rate documents are fed thereto from a high speed feeding device and being adapted to movement between a forward and rearward position, an upper stacking screw worm rotatable about a horizontal axis rigidly attached to said movable stacker carriage which functions to move documents laterally away from said carriage and into stacked relationship, at least one lower stacking screw worm rotatable about a horizontal axis rigidly attached to said movable stacker carriage which functions to move documents laterally away from said carriage and into stacked relationship, the vertical distance between the upper stacking screw worm and the lower stacking screw worm being adjustable, and means for rotating the upper and lower stacking screw worms.

* * * * *

UNITED STATES PATENT AND TRADEMARK OFFICE

CERTIFICATE OF CORRECTION

PATENT NO. : 4,974,826

DATED : December 4, 1990

INVENTOR(S) : EDWARD M. SVYATSKY, K. GEORGE RABINDRAN and KEVIN BEERS

It is certified that error appears in the above-identified patent and that said Letters Patent is hereby corrected as shown below:

Column 10, line 8, "claim 32" should be -- claim 31 -- line 34, "to" should be -- for --

Signed and Sealed this

Twenty-eighth Day of April, 1992

*Attest:*

HARRY F. MANBECK, JR.

*Attesting Officer*

*Commissioner of Patents and Trademarks*